United States Patent [19]

Whitlow et al.

[11] Patent Number: 4,889,059

[45] Date of Patent: Dec. 26, 1989

[54] ROTARY COMBUSTOR WALL AND METHOD OF FORMING SAME

[75] Inventors: Graham A. Whitlow, Murrysville; Suh Y. Lee, Monroeville, both of Pa.

[73] Assignee: Westinghouse Electric Corp., Pittsburgh, Pa.

[21] Appl. No.: 309,742

[22] Filed: Feb. 13, 1989

[51] Int. Cl.[4] ..... A47J 36/00; A47J 36/24

[52] U.S. Cl. ..... 110/246; 110/226; 432/116; 122/6 A; 29/DIG. 48

[58] Field of Search ..... 110/246, 226; 432/116; 122/511, 6 A; 29/DIG. 48

[56] References Cited

U.S. PATENT DOCUMENTS

| | | | |
|---|---|---|---|
| 3,822,651 | 7/1974 | Harris et al. | 110/10 |
| 4,066,024 | 1/1978 | O'Connor | 110/246 |
| 4,226,584 | 10/1980 | Ishikawa | 432/77 |
| 4,724,778 | 2/1988 | Healy | 110/246 |
| 4,726,765 | 2/1988 | O'Connor | 432/118 |
| 4,735,156 | 4/1988 | Johnson et al. | 110/246 |
| 4,735,157 | 4/1988 | Jurusz | 110/246 |
| 4,737,612 | 4/1988 | Bruck et al. | 219/121 |
| 4,782,768 | 11/1988 | Lee et al. | 110/246 |
| 4,793,269 | 12/1988 | Dezubay et al. | 110/246 |

*Primary Examiner*—Edward G. Favors
*Assistant Examiner*—Denise L. Ferensic

[57] ABSTRACT

A rotary combustor has a wall formed from water cooled pipes that are secured together by welded perforated strips. The strips comprise cylindrical shaped metallic rods and the perforations are provided either by forming apertures through the cylindrical shaped metallic rods, or by slots formed between segments by spacing segments of cylindrical shaped rods along the pipes, or by gaps formed between welds that are provided at spaced intervals along the pipes and rods. A method of fabricating a rotary combustor wall is also provided.

16 Claims, 2 Drawing Sheets

ROTARY COMBUSTOR WALL AND METHOD OF FORMING SAME

FIELD OF THE INVENTION

This invention relates to a rotary combustor and more particularly to a rotary combustor wall formed from water cooled pipes having perforations between adjacent pipes for gas flow to the interior of the combustor.

BACKGROUND OF THE INVENTION

The use of water-cooled kilns for the disposal of waste material such as municipal solid wastes or toxic wastes has provided excellent results. In a particular such construction of a combustor, as described in U.S. Pat. No. 3,822,651, water-cooled pipes are used to form a generally cylindrical inner surface for waste combustion, while air for combustion is injected through the cylindrical surface through perforations in webs that secure adjacent pipes together. Such combustors have become known as the Westinghouse-O'Connor combustor, or W-OCC for short. The W-OCC combustor, in the nature of a rotary combustor, is generally illustrated in U.S. Pat. No. 3,822,651, the contents of said patent being incorporated by reference herein, and provides for the water-cooled pipes to be secured together by perforated strips which define a plurality of openings intermediate the pipes so that the inner cylindrical surface is gas porous. Controlled amounts of gas, for burning, are delivered through the porous surface to effect combustion of the material fed therein. In current practice the water-cooled pipes and web joints consist of a fillet weld on the inside and outside surfaces. The wall perforations direct the incoming combustion air from an overfire air windbox to the burning surface of the waste, while underfire air supply is directed into the waste.

Various improvements have been made to the combustor described in U.S. Pat. No. 3,822,651. In U.S. Pat. No. 4,066,024, an imperforate wall is formed with a fluidized bed-type combustor used and a charge of sand used in pyrolysis of waste material. In U.S. Pat. No. 4,226,584, a plurality of projections are provided on the cylindrical surface so as to create a pattern to support burning material slightly spaced from the surface and prevent air flow blockage in the combustor. In U.S. Pat. No. 4,724,778 a system for air control is described which substantially minimizes waste resulting from the supplying of excess air, and permits selective control of underfire air and overfire air, as well as giving zone control of air flow for different stages of burning. In U.S. Pat. No. 4,735,156, the lower end of the pipes are formed so that the generally cylindrical surface becomes a conical surface at the lower end of the combustor and the openings in the strips securing the water-cooled pipes together increase in size at the lower end of the combustor. In U.S. Pat. No. 4,735,157 a plurality of water-cooled baffle pipes and a spherical, associate ring header are provided, with the baffle pipes attached to the interior of the generally cylindrical side wall of the barrel, so as to agitate and transport combustible material from the side wall of the combustion barrel into the flame area. In U.S. Pat. No. 4,782,768, slanted openings are provided in the connecting webs for the water-cooled pipes so as to direct the combustion gas supply into the interior of the combustion barrel at an acute angle to a vector corresponding to the direction of rotation of the combustor.

A particular problem of molten aluminum resulting from combustion of municipal waste is addressed in the improvement described in U.S. Pat. No. 4,726,765, the contents of which are incorporated herein. As described therein, municipal solid waste contains significant amounts of aluminum, from cans and other forms of packaging, with molten aluminum from combustion of waste accumulating in the lower portion of the drum which can spill through the air openings in the drum wall into the air ducts. The '765 improvement provides for shallow walls about the side and upper ends of the holes, the upper end of the walls preferably rounded, so as to prevent molten material, typically aluminum, from flowing or dripping through the holes into the windbox.

While all of these improvements to the W-OCC combustor serve the functions for which they were designed, a factor that still remains is the time consuming task of welding webs to adjacent water-cooled pipes to form the inner cylindrical surface. Such webs are generally flat stock about 2.54 to 3.81 cm (1 to 1.5 inch) wide and 1.27 cm (0.5 inch) thick and the ends must be prepared for welding the same to the pipes having an outer diameter of about 5.08 cm (2 inches). Also, the perforated webs are sometimes subject to excessive wear and do not have as long a service life as would be desirable.

It is an object of the present invention to provide a combustor that has perforated connections between adjacent water-cooled pipes that provide longer service life.

It is another object of the present invention to provide a combustor that directs molten aluminum away from perforations between adjacent water-cooled pipes and avoids the problem of aluminum drippings removal from windboxes.

It is a further object of the present invention to provide a method for improved fabrication and assembly of a combustor, which permits a more simple welding procedure between adjacent water-cooled pipes and connecting members which form the generally cylindrical inner surface of the combustor.

SUMMARY OF THE INVENTION

A rotary combustor having a wall formed from a plurality of water cooled pipes that are secured together to define a cylindrical surface, with perforated strips used to secure the pipes to each other and provide gas flow into the combustor chamber, where the strips are in the form of cylindrical shaped metallic rods. The cylindrical shaped metallic rods are welded to adjacent pipes, parallel to the axes of the pipes.

In one embodiment of the present invention, the perforations are in the form of apertures formed through the cylindrical shaped metallic rods and the welds provided completely along the length of the rods. In a second embodiment, the perforations are in the form of spacing, or slots, between adjacent spaced segments of rods, and the segments of cylindrical shaped rods are welded to adjacent water cooled pipes. In a further embodiment, the perforations are in the form of spacing, or gaps, between welds that are made at spaced intervals along the cylindrical shaped rods and adjacent water cooled pipes.

The adjacent water cooled pipes have a diameter substantially disposed along a common arc and the cylindrical shaped metallic rods have a diameter that is preferably disposed along the same arc.

The method of fabricating a rotary combustor wall includes disposing cylindrical shaped rods between adjacent water cooled pipes parallel the axes of the pipes, with the diameters of adjacent pipes and of the cylindrical shaped rods substantially disposed along a common arc, providing perforations between adjacent pipes, and welding the cylindrical shaped metallic rod to the adjacent pipes.

Brief Description of the Drawings

The invention will become more readily apparent from the following description of preferred embodiments thereof shown, by way of example only, in the accompanying drawings, wherein.

Detailed Description

Figure 1:
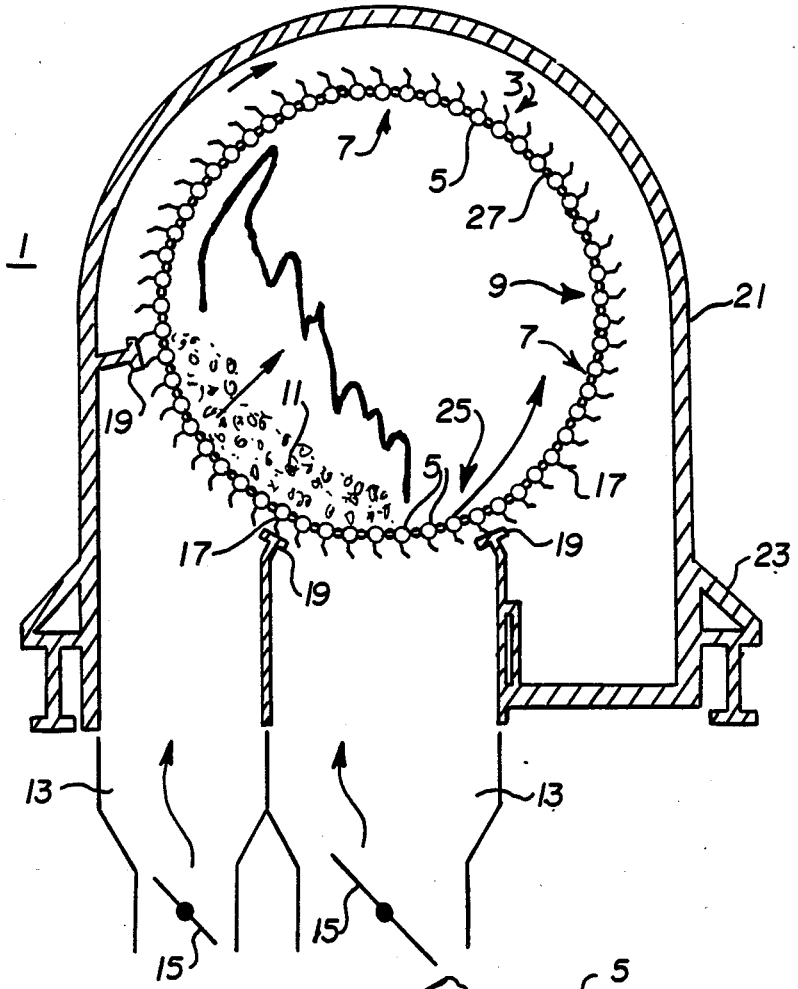
FIG. 1 is a cross-sectional, end elevational schematic view of a rotary combustor according to the present invention.

Referring now to FIG. 1, a rotary combustor 1 includes a generally cylindrical combustor wall 3 coprised of a plurality of water cooled pipes 5 that are connected together by strips 7, along parallel axes so as to form an inner generally cylindrical surface 9. The rotary combustor 1 is adapted for rotation and, as a result of rotation, burning waste material 11 is slowly tumbled and is moved axially along the inner generally cylindrical surface 9 for combustion with air. Air for combustion is supplied by windboxes 13 disposed under the combustor 1, with dampers 15 provided in the windboxes to control the air flow. The windboxes 13 receive the combustion air under pressure from a blower (not shown), which pressure is maintained by seal strips 17 which extend at least the axial length of one windbox 13 and helps form a pressure seal against windbox edges 19 so that combustion air charged through the windboxes 13 enters the combustor 1, as indicated by the arrows in FIG. 1. Exhaust gases generated by the combustion of waste material 11 are contained by a housing 21 supported by a framework 23. Underfire air is directed into the water, as indicated at the left side of FIG. 1, while overfire air is directed to the burning surface of the waste, as indicated at the right side thereof. The combustion air is directed from the windboxes 13 through intermediate openings 25 between the pipes 5, thus providing gas porosity through the inner generally cylindrical surface 9.

Figure 2:
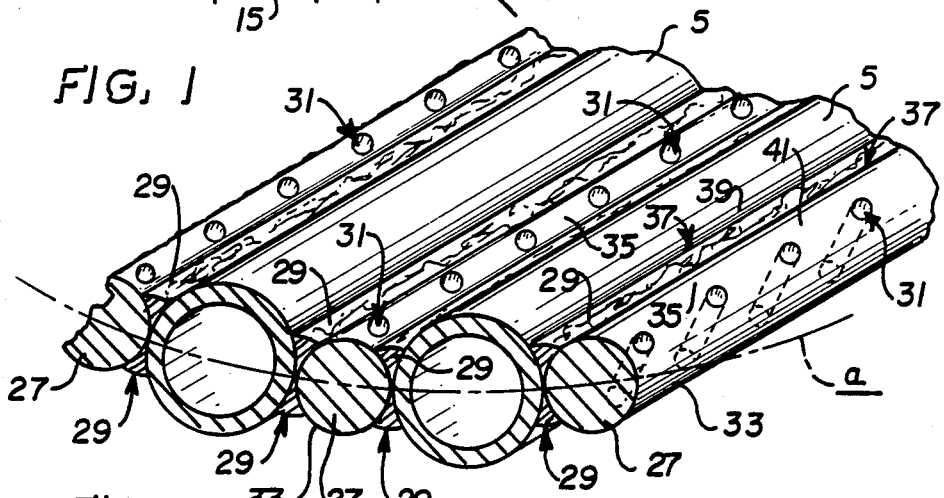
FIG. 2 is a perspective view of a fragmentary portion of the first embodiment of the present invention.

In accordance with the present invention, the strips 7 are in the form of generally cylindrical shaped rods 27 which are secured to adjacent water cooled pipes 5, parallel to the axes of the pipes, by welds 29 (FIG. 2). In the embodiment illustrated in FIG. 2, the generally cylindrical shaped rods 27 are secured to adjacent water cooled pipes 5 by welds 29, which extend completely along the water cooled pipes 5 and rods 27, to close the combustor wall 3, with perforations between the water cooled pipes 5 provided by apertures 31 formed through the cylindrical shaped rods 27 from the outer surface 33 through to the inner surface 35 thereof. The apertures 31 may be drilled, laser cut or otherwise formed in the cylindrical shaped rods 27 before welding to adjacent pipes 5 or after such welding, and may be in the form of circular apertures or slots of any desired shape. The welding of the cylindrical shaped rods 27 to the adjacent water cooled pipes is preferably effected so as to leave a trough 37 between a face 39 of a water cooled pipe and an adjacent face 41 of a cylindrical shaped rod 27. In the instance where molten aluminum such as from the incineration of beverage cans is produced, the molten aluminum will tend to flow towards trough 37 from faces 39 and 41 and away from the apertures 31. Such molten aluminum would collect in the trough 37 and flow thereby to a location distant from windboxes 13 and reduce or eliminate an existing time consuming problem of removal of such molten aluminum drippings from the windboxes.

In the method of fabricating the combustor wall 3 formed from a plurality of water cooled pipes 5 secured together along parallel axes to define the inner generally cylindrical surface 9, the pipes 5, such as 5.08 cm (2.0 inch) outer diameter tubes are alternated with 2.54 cm (1 inch) rods. The tubes and rods are welded together by any suitable welding procedure, such as conventional MIG fillet welding, plasma arc welding (keyholing down to the tangent point) with filler metal additions, or laser welding with filler metal additions. A particularly useful laser welding technique is described in U.S. Pat. No. 4,737,612, assigned to the assignee of the present invention, modified for the particular geometry described herein.

To fabricate the combustor wall, a plurality of the water cooled pipes are adjacently aligned along axes which are parallel and a cylindrical shaped metallic rod disposed between adjacent said pipes. The use of round pipes and the cylindrical shaped rods provides a resultant V-shaped groove adjacent their contact points for efficient welding. The pipes and rods are preferably aligned such that adjacent pipes have a diameter substantially disposed along a common arc a, and with the cylindrical shaped metallic rod having a diameter substantially disposed along the same arc (FIG. 1). Perforations are provided between the adjacent pipes, in the nature of apertures in FIG. 1, through the cylindrical shaped rods, and the rods are welded to the adjacent pipes. The apertures 31 are transverse the arc along which the water cooled pipes and cylindrical shaped rods are disposed and may be slanted or angled as described in U.S. Pat. No. 4,782,768 assigned to the assignee of the present invention.

Although the raw material cost of round rod web is somewhat greater than that of flat stock, as is used in present combustors, this increase would present only a small economic impact, when factored into the combustor cost and potential cost savings resulting from the improvements described herein.

Although the rods can be carbon steel, use of a corrosion resistant material, such as Inconel 625, for the cylindrical shaped metallic rods would extend the service life by many orders of magnitude when compared to current, carbon steel, combustor tube to web design.

In addition to the ease and completeness of the welded fabrication approach, a principal advantage of the use of cylindrical shaped connecting members between the water cooled pipes is the corrosion-erosion resistance provided. A problem of reduction in web section thickness with increasing exposure time due to chloride accelerated oxidation and erosion in existing combustors is receiving important consideration. Because the corrosion mechanism is temperature dependent, the most severe metal wastage region of existing connecting webs lies along the web centerline. This is because the maximum temperature is recorded at this location due to cooling of the connector being most efficient next to the water cooled pipes and least efficient at the greatest distance from the pipes, i.e. the connector centerline. The problem of such connection corrosion is discussed in more detail in U.S. Pat. No. 4,793,269 assigned to the assignee of the present invention. In the present invention, using cylindrical shaped metallic rods between the water cooled pipes, the maximum thickness of the connector is placed at the same location as that of the maximum metal wastage, i.e. at the centerline. Thus the service life between successive combustor tube connector replacement or refurbishment is very much increased, enhancing the economics and quality of the combustor.

Figure 3:
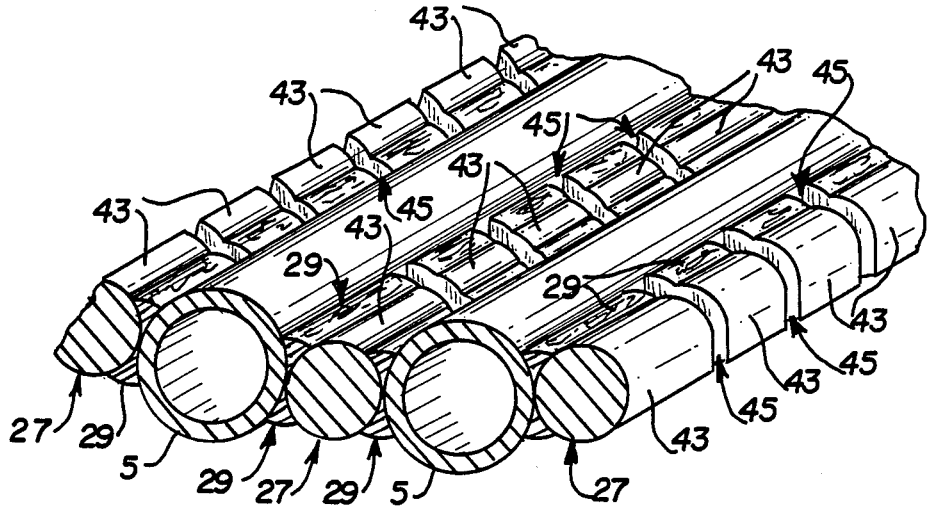
FIG. 3 is a perspective view of a fragmentary portion of another embodiment of the present invention.

In a second embodiment of the combustor of the present invention, the perforations for air flow into the combustor chamber are provided by using spaced segments of the cylindrical shaped metallic rod. As illustrated in FIG. 3, the cylindrical shaped rod 27 is in the form of a plurality of segments 43 that are axially spaced along the length of the water cooled pipes 5, with the perforations provided by slots 45 that are formed by the spaces between adjacent segments 43. The welds 29 secure each of the segments 43 to adjacent water cooled pipes 5, such that only the slots 45 are available for flow of gases to the interior chamber of the combustor. The slots 45 may be of any desired size and geometry.

Figure 4:
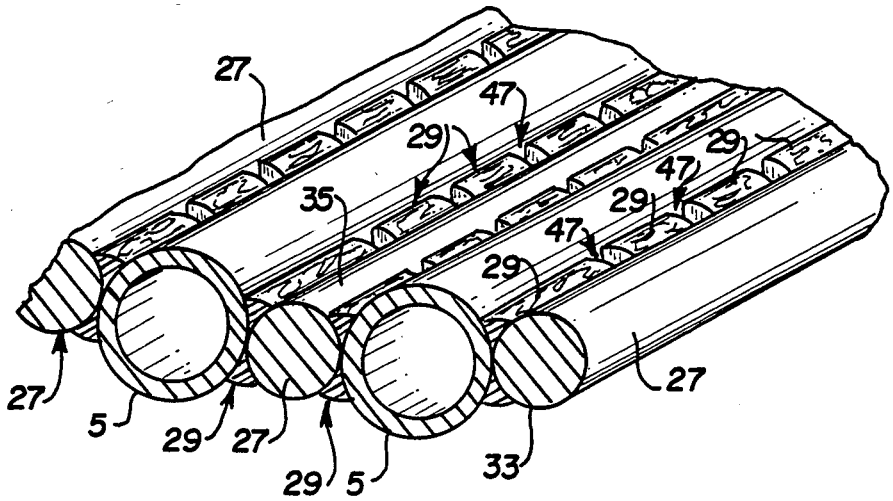
FIG. 4 is a perspective view of a fragmentary portion of a further embodiment of the present invention.

In a further embodiment, illustrated in FIG. 4, the cylindrical shaped rods 27 are secured to adjacent water cooled pipes 5 by discontinuous welds to provide the perforations necessary for air flow into the combustor. As illustrated, gaps 47 are provided between welds 29 along the length of the cylindrical shaped rods 27, with the gaps 47 formed by the spacing between adjacent such welds. The gaps 47 extend from outside the combustor 1 through to the interior chamber and allow air flow into the chamber for combustion of waste thereon.

The present invention provides a combustor having a longer service life before metal losses necessitate refurbishment or replacement of the connectors between the water cooled pipes, by placement of the maximum thickness of the tube connector at the location of maximum metal loss. Also, reduced fabrication costs result due to the elimination of the edge preparations needed on current flat web connectors, with comparable if not better quality welds and have improved heat transfer. In addition, by use of the first embodiment described, the potential elimination of the aluminum drippings problem in the windboxes, by placement of the connector perforations at the highest point on the connector, the aluminum may then be safely and easily channelled along the combustor to the ash pit.

What is claimed is:

1. In a combustor having a plurality of water cooled pipes secured together along parallel axes to define an inner generally cylindrical surface, said pipes secured together by perforated strips so as to define a plurality of intermediate openings between said pipes, thereby providing gas porosity through said cylindrical surface, the improvement wherein said strips comprise cylindrical shaped metallic rods secured by welds to adjacent pipes, parallel said axes, and said perforations are provided between said pipes.

2. In a combustor as defined in claim 1, the improvement wherein said perforations are provided by apertures formed through said cylindrical shaped metallic rods.

3. In a combustor as defined in claim 1, the improvement wherein said cylindrical shaped metallic rods are comprised of a plurality of spaced segments of rods and said perforations are provided by the slots formed between adjacent spaced segments.

4. In a combustor as defined in claim 1, the improvement wherein said cylindrical shaped metallic rods are welded to said pipes at spaced intervals therealong and said perforations are provided by gaps formed between adjacent welds.

5. In a combustor as defined in claim 1, the improvement wherein said cylindrical shaped metallic rods are formed from a corrosion resistant material.

6. In a combustor as defined in claim 5, the improvement wherein said corrosion resistant material is Inconel 625.

7. In a combustor as defined in claim 1, the improvement wherein adjacent pipes each have a diameter substantially disposed along a common arc and a said cylindrical shaped metallic rod has a diameter substantially disposed along said arc.

8. In a combustor having a plurality of water cooled pipes secured together along parallel axes to define an inner generally cylindrical surface, said pipes secured together by perforated strips so as to define a plurality of intermediate openings between said pipes, thereby providing gas porosity through said cylindrical surface, the improvement wherein said strips comprise cylindrical shaped metallic rods, having apertures formed therethrough to provide said perforations, secured by welds to adjacent pipes, parallel said axis.

9. In a combustor having a plurality of water cooled pipes secured together along parallel axes to define an inner generally cylindrical surface, said pipes secured together by perforated strips so as to define a plurality of intermediate openings between said pipes, thereby providing gas porosity through said cylindrical surface, the improvement wherein said strips comprise a plurality of spaced segments of cylindrical shaped rods secured by welds to adjacent pipes, parallel said axes, and said perforations are provided by slots formed between adjacent spaced segments.

10. In a combustor having a plurality of water cooled pipes secured together along parallel axes to define an inner generally cylindrical surface, said pipes secured together by perforated strips so as to define a plurality of intermediate openings between said pipes, thereby providing gas porosity through said cylindrical surface, the improvement wherein said strips comprise cylindrical shaped metallic rods secured by welds, at spaced intervals therealong to adjacent pipes, parallel said axes, and said perforations are provided by gaps formed between adjacent welds.

11. A method of fabricating a rotary combustor wall formed from a plurality of water cooled pipes secured together along parallel axes to define an inner generally cylindrical surface, comprising:

disposing between adjacent pipes a cylindrical shaped metallic rod parallel said axes, with said adjacent pipes each having a diameter substantially disposed along a common arc and said cylindrical shaped metallic rod having a diameter substantially disposed along said arc;

providing perforations between said adjacent pipes; and welding said cylindrical shaped metallic rod to said adjacent pipes.

12. The method of fabricating a rotary combustor wall as defined in claim 11 wherein said cylindrical shaped rods are formed from a corrosion resistant material.

13. The method of fabricating a rotary combustor wall as defined in claim 12 wherein said corrosion resistant material is Inconel 625.

14. The method of fabricating a rotary combustor wall as defined in claim 11 wherein said perforations are provided by forming apertures through said cylindrical shaped metallic rods transverse said arc and intermediate said welds.

15. The method of fabricating a rotary combustor wall as defined in claim 11 wherein a plurality of spaced segments are provided to form said cylindrical shaped metallic rod and said perforations are provided by spacing adjacent segments to define a slot therebetween prior to welding the same to said adjacent pipes.

16. The method of fabricating a rotary combustor wall as defined in claim 11 wherein said perforations are provided by welding said cylindrical shaped metallic rod to said adjacent pipes only at spaced intervals therealong to leave gaps between adjacent spaced welds defining said perforations.

* * * * *